US006138902A

United States Patent [19]

Welch

[11] Patent Number: 6,138,902

[45] Date of Patent: Oct. 31, 2000

[54] INSULATED FOLDABLE RECEPTACLE FOR CONTAINERS

[75] Inventor: James Welch, Austin, Tex.

[73] Assignee: Weekend 2000, Inc., Austin, Tex.

[21] Appl. No.: 09/134,639

[22] Filed: Aug. 14, 1998

[51] Int. Cl.[7] ..... B65D 5/36

[52] U.S. Cl. ..... 229/103.11; 206/815; 220/737; 220/739

[58] Field of Search ..... 229/103.11; 206/804, 206/815; 220/592.24, 592.25, 737, 739, 902, 903

[56] References Cited

U.S. PATENT DOCUMENTS

| | | | |
|---|---|---|---|
| 2,936,068 | 5/1960 | Munkachy | 220/737 |
| 3,420,363 | 1/1969 | Blickensderfer | 220/902 |
| 4,648,525 | 3/1987 | Henderson | 220/739 |
| 5,147,041 | 9/1992 | Lemieux et al. | 206/815 |
| 5,445,315 | 8/1995 | Shelby | 220/903 |
| 5,450,953 | 9/1995 | Reisman | 206/804 |

*Primary Examiner*—Gary E. Elkins

*Attorney, Agent, or Firm*—Charles J. Rogers; Winstead Sechrest & Minick P.C.

[57] ABSTRACT

An insulated receptacle for receiving a container which is formed of a laminate of paper and foam. The receptacle is foldable and thus can be readily compressed and stored for future use. Opposite side walls of the receptacle include cut-out portions for readily gripping a container for inserting into and removing from the receptacle.

6 Claims, 2 Drawing Sheets

INSULATED FOLDABLE RECEPTACLE FOR CONTAINERS

This invention relates to a foldable receptacle container adapted to receive a cold or warm container and retain it within a desired temperature range of its initial temperature. The receptacle is readily openable and can be conveniently packed, stored and transported.

BACKGROUND OF THE INVENTION

There are currently a number of receptacles that can be used for retaining a container that is to be maintained around the temperature it is received. For example, it is common to use an insulator around a coffee cup so that it can be held without being subject to the heat or an insulated receptacle to hold a cold beverage container with ease.

These known type of receptacles come in many sizes and shapes and there has long been a need to have a receptacle that can be completely folded, that is suitably insulated and which can be carried by merely slipping it into a purse or a pocket. In addition it is desirable that the container disposed in the receptacle be readily available and to this end the receptacle is constructed so that even if the container is totally disposed within the receptacle it can be gripped due to the provision of cut out portions that facilitate gripping the container completely located within the receptacle to remove it therefrom. It is noted that there have been a variety of such receptacles made of paper, corrugated material, insulated foam and so forth but there has long been a need for a very simple foldable laminated receptacle paper and foam receptacle with the receptacle in the unfolded position being constructed and arranged so that the container disposed within the receptacle can be readily removed and placed therein.

SUMMARY OF THE INVENTION

In accordance with the present invention there is provided a foldable receptacle made of a laminate constructed of a polyethylene foam and paper that is bonded together. The laminated material is formed and cut-out to facilitate ready shaping of the laminated blank into a typical bag configuration. The bag is designed to form compact folding edges without impairing the insulating properties. The receptacle does not have to have a tight fit to perform its functions. The opposite side walls of the rectangular receptacle include cut-out portions so that the container that is located completely within the bag can be readily removed therefrom.

DETAILED DESCRIPTION OF THE PREFERRED EMBODIMENT

Figure 1:
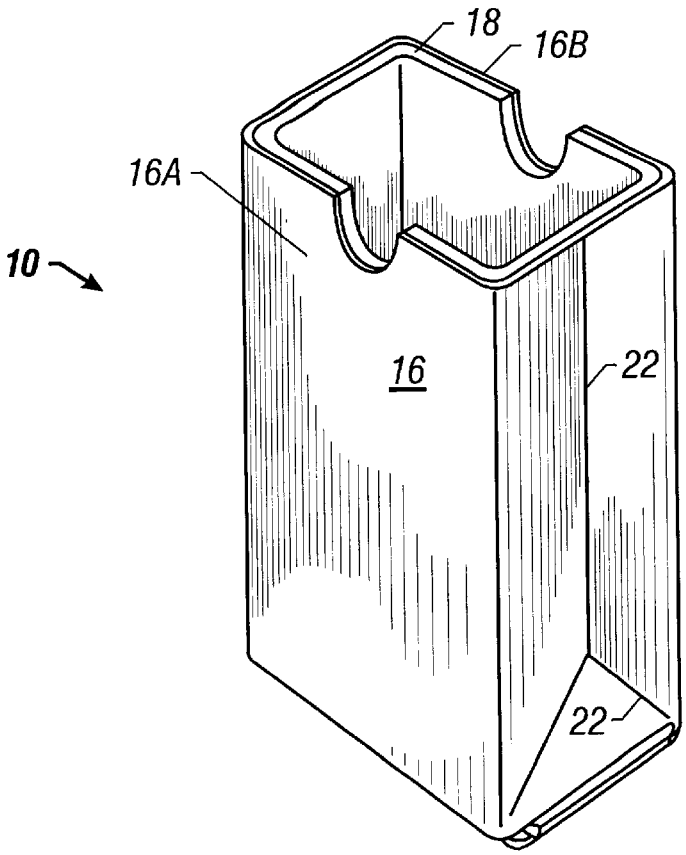
FIG. 1 is a preferred embodiment of an insulated bag in its open state for receiving a container to be retained at the temperature it is received.
Figure 2:
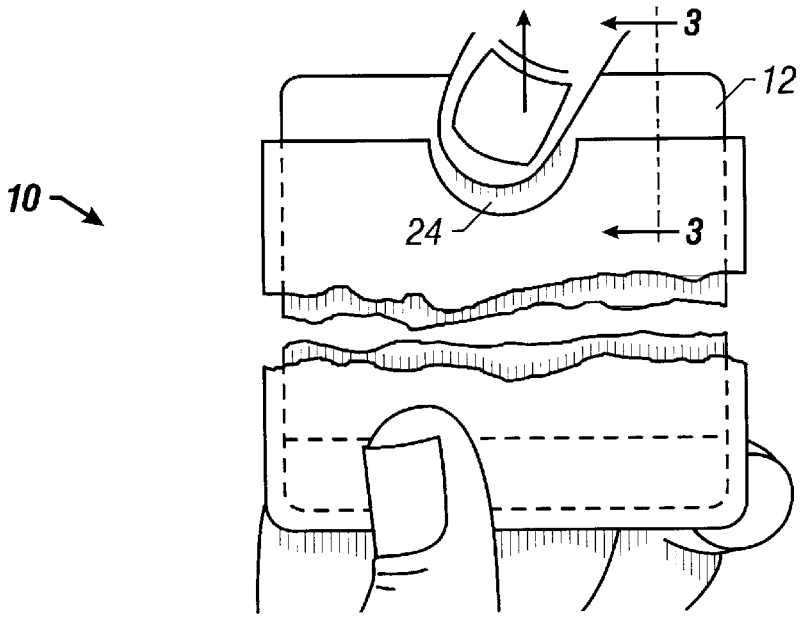
FIG. 2 is a side view showing a can being removed from the insulated bag.
Figure 4:
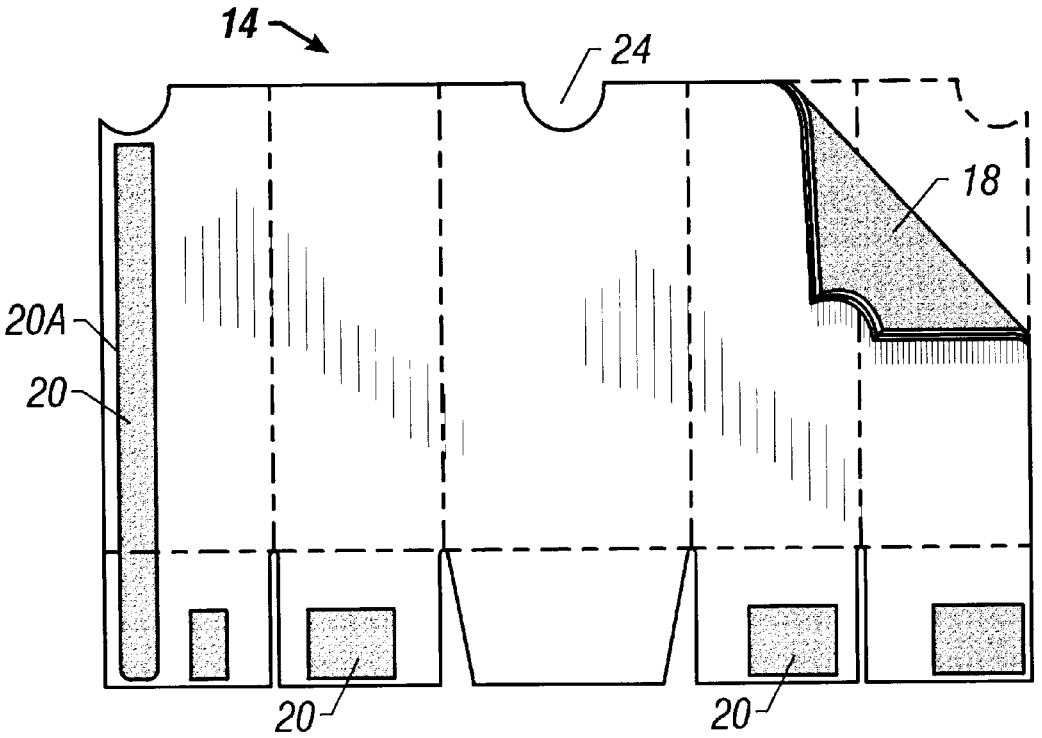
FIG. 4 illustrates a blank from which the rectangular bag version of the insulated bag is formed.

In referring first to FIG. 1 there is shown the receptacle 10 in its open position to receive a container such as a can 12 (FIGS. 1 and 2) or the like therein. The receptacle 10 is in the form of a rectangular bag that is formed from a laminate of paper and a polyethylene foam. The bag 10 is shown as a blank 14 in FIG. 4 that is folded, creased and glued to form the bag of FIG. 1 by bag making machinery that currently exists. The blank 14 consists of a Kraft paper sheet 16 that is laminated such as by gluing to a comparably shaped sheet of polyethylene 18 or the lamination can take place in sheet form and the blank 14 die-cut from the laminated sheet of paper and polyethylene. The polyethylene foam is then glued to the paper by a non water soluble glue so that in the event the paper becomes moistened there will not be any delaminating of the foam from the paper backing. The blank shown in FIG. 4 has a number of glue areas 20 that are so located that when the blank 14 is folded by a conventional bag forming machinery the bag will be formed into the receptacle shown in FIG. 1 and will be glued together to retain its shape. As shown in FIG. 1 the edges of the blank are overlapped and the glue line 20A that extends the full height of the package retains the blank in its formed position. It is noted that the fold lines 22 of the receptacle is such that the receptacle can be closed in an accordion type fashion to a flattened condition and can be readily inserted into a hand bag or a pocket to facilitate carrying the bag for a future use so that it can be repeatedly used to insert a container into the bag that is to be retained in a certain temperature range. It is noted that the polyethylene foam is an insulator and thus when something warm is introduced into the receptacle it will retain the temperature level and conversely if a cold container is placed into the receptacle the cold container will be retained in the cold state for an extended period of time.

Figure 3:
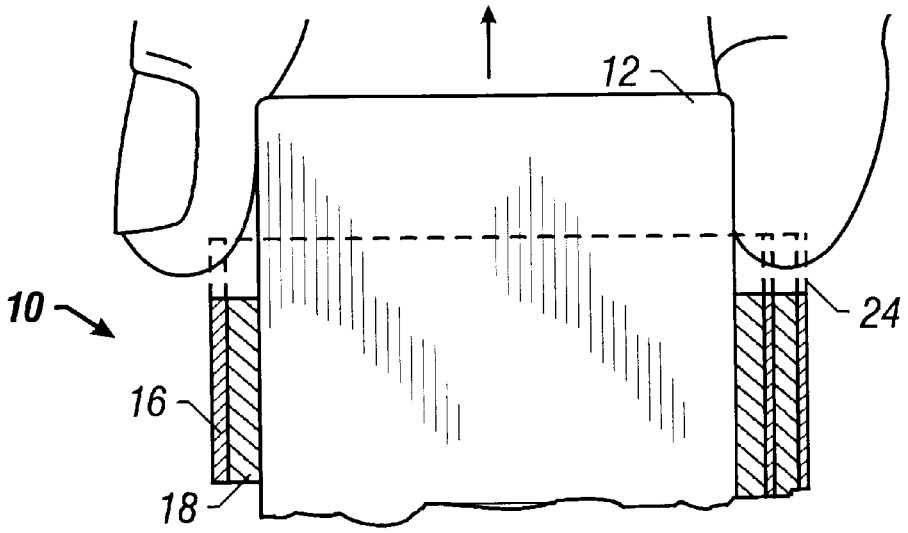
FIG. 3 is a view taken along the line 3—3 of FIG. 2.

It is important to note that there are cut-out portions 24 that are so located in the opposite side walls 16A, 16B of the receptacle. When the blank of FIG. 4 has been folded into the desired configuration it can be seen from FIGS. 2 and 3 that the cut-out portions 24 facilitate the introduction and removal of the container with respect to the receptacle. Without these cut-out portions it may be difficult to conveniently introduce and remove a container relative to the insulated bag when the container has a length in excess to the length of the bag itself.

It is intended to cover by the intended claims all improvement and modifications that fall within the true spirit and scope of the invention

What is claimed is:

1. A receptacle for removably disposing a beverage container, said receptacle comprising:

an outer shell forming an opening at one end thereof, said shell being formed of a pliant paper;

an inner insulating layer connected within said outer shell along substantially the whole interior surface thereof adapted for disposing a beverage container therein; and at least two cut-outs formed by said outer shell and said inner layer opposite one another and proximate said opening;

wherein said outer shell and said inner layer may be folded longitudinally and/or laterally and/or rolled for storage when said container is removed therefrom.

2. The receptacle of claim 1, wherein:

said inner insulating layer is formed of polyethylene.

3. The receptacle of claim 1, wherein:

said outer shell and said inner insulating layer form a substantially rectangular shape.

4. The receptacle of claim 2, wherein:

said outer shell and said inner insulating layer form a substantially rectangular shape.

5. A receptacle for removably disposing a beverage container, said receptacle comprising:

an outer shell having a substantially rectangular shape forming a single opening at one end thereof, said shell being formed of a pliant paper;

an inner insulating layer connected within said outer shell along substantially the whole interior surface thereof adapted for disposing a beverage container therein; and at least two cut-outs formed by said outer shell and said inner layer opposite one another and proximate said opening;

wherein said outer shell and said inner layer may be folded longitudinally and/or laterally and/or rolled for storage when said container is removed therefrom.

6. The receptacle of claim 5, wherein:

said inner insulating layer is formed of polyethylene.

* * * * *